US005315933A

United States Patent [19]

Paulsson et al.

[11] Patent Number: 5,315,933

[45] Date of Patent: May 31, 1994

[54] LAUNCHING SYSTEM

[75] Inventors: Lars Paulsson, Kirstinehamn; Lennart Eriksson, Karlskoga, both of Sweden

[73] Assignee: Bofors AB, Karlskoga, Sweden

[21] Appl. No.: 964,963

[22] Filed: Oct. 22, 1992

[30] Foreign Application Priority Data

Oct. 23, 1991 [SE] Sweden ..... 9103081

[51] Int. Cl.[5] ..... F42B 12/58

[52] U.S. Cl. ..... 102/489; 102/357; 102/386; 102/393

[58] Field of Search ..... 102/340, 342, 345, 351, 102/352, 357, 360, 384, 385, 386, 387, 388, 393, 489, 505

[56] References Cited

U.S. PATENT DOCUMENTS

| | | | |
|---|---|---|---|
| 3,677,182 | 7/1972 | Peterson | 102/505 |
| 3,712,224 | 1/1973 | Hanzel | 102/357 |
| 4,498,393 | 2/1985 | Fischer et al. | 102/393 |
| 5,111,748 | 5/1992 | Thurner et al. | 102/393 |
| 5,155,294 | 10/1992 | Vesa | 102/384 |
| 5,160,800 | 11/1992 | Travor et al. | 102/393 |

FOREIGN PATENT DOCUMENTS

| | | | |
|---|---|---|---|
| 2429912 | 1/1975 | Fed. Rep. of Germany | 102/340 |

*Primary Examiner*—Harold J. Tudor
*Attorney, Agent, or Firm*—Pollock, Vande Sande & Priddy

[57] ABSTRACT

A method of separating a sub-combat unit from a protective canister. The method comprises the steps of discharging the sub-combat unit from the protective canister by causing a displacement of a driving sabot within the protective canister. The driving sabot is displaced by an elevated gas pressure generated by the combustion of a gas-generating pyrotechnical charge. The displacement of the sabot imparts a trajectory to the sub-combat unit. The displaceable driving sabot is prevented, by arrest means interconnected between the driving sabot and the canister, from accompanying the sub-combat unit in its new trajectory. A division of the protective canister into a plurality of parts is caused. The division ensures a change in at least one of the trajectory and the velocity of the parts of the canister.

10 Claims, 2 Drawing Sheets

LAUNCHING SYSTEM

FIELD OF THE INVENTION

The present invention relates to a launching system for sub-combat units provided with their own triggering sensors. The launching system includes a carrier or vehicle body in the form of a shell or missile transported to a predetermined target area. At the target area, the sub-combat unit is launched from the carrier body. The sub-combat unit falls towards the earth, scanning the target area with its sensors in a helical pattern and combating any possible identified targets such as AFV's.

The fundamental principle of the sub-combat unit of the type contemplated here is described in SE-A22-8601423 (452405) corresponding to U.S. Pat. No. 4,858,532 to Persson et al.

BACKGROUND OF THE INVENTION

The characterizing feature of the sub-combat unit described in the above referenced patent is that it is provided with a pivotally disposed target identification and triggering sensor and with one or more similarly outwardly pivotal aerodynamic surfaces. Together, the sensors and the aerodynamic surfaces provide, in their flip-out positions, the sub-combat unit with a suitably balanced retarding area which imparts to the unit the predetermined fall speed and rotation which make it possible for the sensors to scan the relevant target area for targets to be combatted.

Publications SE-A0-8903473-0 corresponding to U.S. Pat. No. 5,063,849 to Axinger and SE-A0-9001227-9 corresponding to U.S. Pat. No. 5,155,294 to Vesa further describe variations of flip-out aerodynamic surfaces intended for sub-combat units of the type contemplated here. The aerodynamic surfaces may also consist of parachutes.

As will be apparent from the above disclosure and in greater detail from the above-mentioned references, the sub-combat units are provided with a plurality of flip-out parts which, during the launching process from the carrier or vehicle body, must be protected from damage. At the same time, the pre-planned scanning of the target area requires that the flip-out of these parts take place exactly as pre-planned.

A further problem which must be solved is that, since each carrier body contains several sub-combat units, systems must be integrated in the design which give the different sub-combat units a desired spread and ensure that launched parts do not collide with one another in the air after launching.

Launching of the sub-combat units from the carrier body is most simply put into effect using a powder charge which, rearwardly in the flight direction of the carrier body, forces out all sub-combat units as one single unit. This launching thus implies a certain desirable simultaneous retardation of the movement of the sub-combat units in the flight direction, but this necessitates that the more sensitive parts of the sub-combat units must be protected from damage. Moreover, the different sub-combat units must thus be separated before their aerodynamic surfaces and sensors can be flipped out.

The separation between the different sub-combat units can be effected in that these are retarded to different degrees after being launched so that the sub-combat unit which was originally placed most forwardly in the carrier body is retarded least. The retardation is progressively increased on those sub-combat units which were placed further rearwardly in the carrier body.

Once the desired retardation has taken place, the sub-combat units must be released from these specific retarder devices before carrier surfaces and sensors can be flipped out. If the carrier body or vehicle has been rotation-stabilized, rotation brakes may also be included. The problem inherent in protecting the sub-combat units during the launching phase and the requirement of having access, during the specific separation phase, to retarder devices connected to the sub-combat units is solved by surrounding the sub-combat units with specific protective canisters. The retarder devices and possibly rotation brakes may be secured to the protective canister. Also, the sub-combat units are, in their turn, discharged from the protective canister once the desired retardation in respect of both rotation and flight speed has been completed.

The protective canister can then simultaneously be utilized for holding the aerodynamic surfaces and the sensors in the inwardly folded state. This implies that the aerodynamic surfaces and the sensors will be flipped out as soon as the sub-combat unit has left its protective canister. Discharge of the sub-combat unit from the protective canister must, however, be affected in such a manner that no parts are damaged. At the same time, it must be ensured that the now activated sub-combat unit runs no risk of colliding with its own former protective canister or corresponding canisters from other sub-combat units.

The present invention therefore relates to a method and an apparatus intended to solve the above-described specific problems. Accordingly, the present invention entails a method of discharging sub-combat units from their protective canisters without sensors and aerodynamic surfaces being damaged. At the same time, the mutually separated canisters and sub-combat units are given different fall trajectories and fall speeds. The different trajectories and speeds eliminate the risk of collision between the sub-combat units and the canisters. The present invention also includes an apparatus designed in accordance with the above-described method.

According to the present invention, the sub-combat unit is designed in accordance with the above-disclosed general guidelines. Thus upon departed from the vehicle or carrier body enclosed in its protective canister the sub-combat unit is in turn discharged out of the protective canister by a driving sabot or ram disposed between the bottom of the canister and the sub-combat unit and displaceable towards the open end of the canister. Behind the sabot or ram, an elevated gas pressure is generated by combustion of a gas-generating pyrotechnical charge which is initiated at the point in time of discharge of the sub-combat unit. According to the present invention, the protective canister must further be provided with arrest means which rapidly retard the driving sabot as soon as the sabot has imparted the desired discharged velocity to the sub-combat unit, so that the driving sabot does not accompany the sub-combat unit in its new trajectory. The arrest or braking means suitably consist of initially folded brake bands which are stretched on displacement of the driving sabot when the brake bands are fully stretched, they impart to the now empty protective canister a tumbling motion. According to one development of the present invention, the jerk generated on activation of the arrest means can then be utilized to cause the protective canister to divide into several parts. In a preferred embodiment, the stretching of the brake bands causes a division of the protective canister. The division of the canister further ensures that the sub-combat unit and canister parts achieve different fall speeds. This division can be effected in that the protective canister is made from several parts which are joined together in such a manner that there are natural indications of fracture between the parts.

BRIEF DESCRIPTION OF THE DRAWINGS

The method and the apparatus according to the present invention are defined in the appended claims and will now be described further with particular reference to a number of exemplifying drawings.

In the accompanying drawings:

FIG. 1*a* is a section taken along the line A—A in FIG. 3 with the sub-combat unit in place within the protective canister;

FIG. 1*b* shows the same section as FIG. 1*a* but in the position immediately after the sub-combat unit has been discharged, while FIG. 2*a* shows the section taken along the line B—B in FIG. 3 in the same position as FIG. 1*a;* and finally FIG. 2*b* shows the same lateral section as FIG. 2*a* but at the same functional position as FIG. 1*b*.

The same reference numerals have been employed on all figures.

DETAILED DESCRIPTION OF PREFERRED EMBODIMENT

Figure 2A:
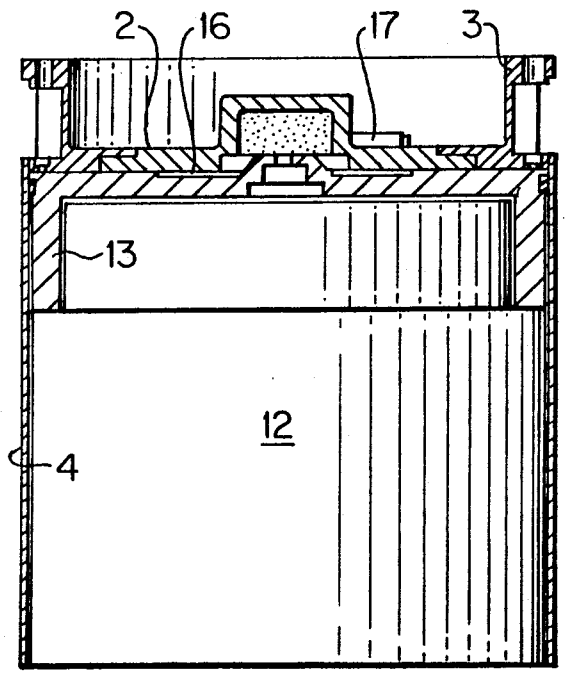
FIGS. 1*a*, 1*b* and 2*a*, 2*b* show lateral sections through FIG. 3 and an end elevation of a protective canister of the type characteristic of the present invention, more specifically.
Figure 1B:
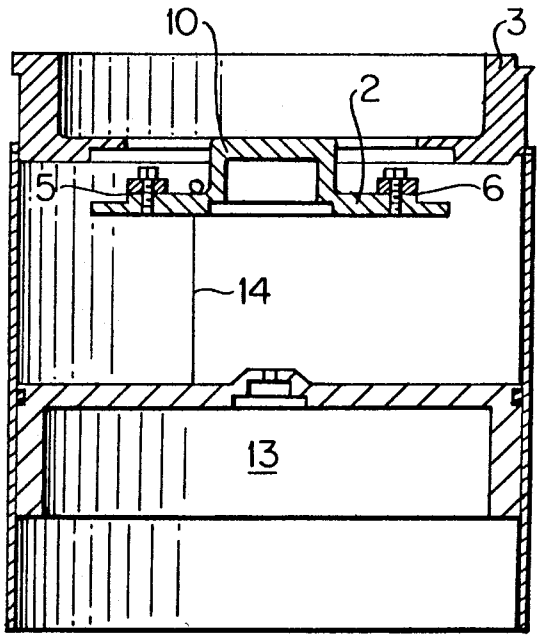
Figure 1A:
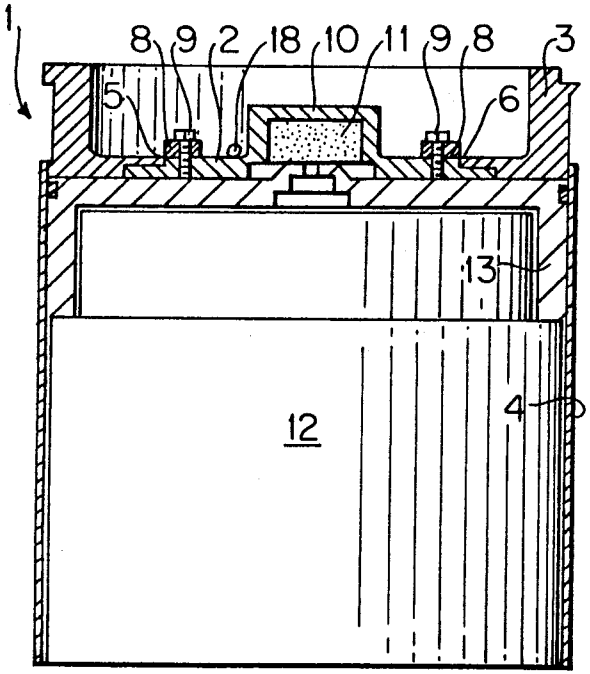

The protective canister 1 is composed of an inner bottom portion 2, an annular outer bottom portion 3 disposed concentrically around the inner bottom portion, and a tubular protective can 4. The protective can 4 is glued or welded to the outer edge of the outer bottom portion 3, and the inner bottom portion 2 is inserted in the central aperture of the outer bottom portion by means of shear pins or keepers 5 and 6. The shear pins or keepers are secured by means of specifically adapted washers and bolts 8 and 9, respectively. A pyrocharge is disposed in a specifically adapted combustion chamber 10 in the inner bottom portion, and its discharge generates gas 11 on its initiation.

Figure 2B:
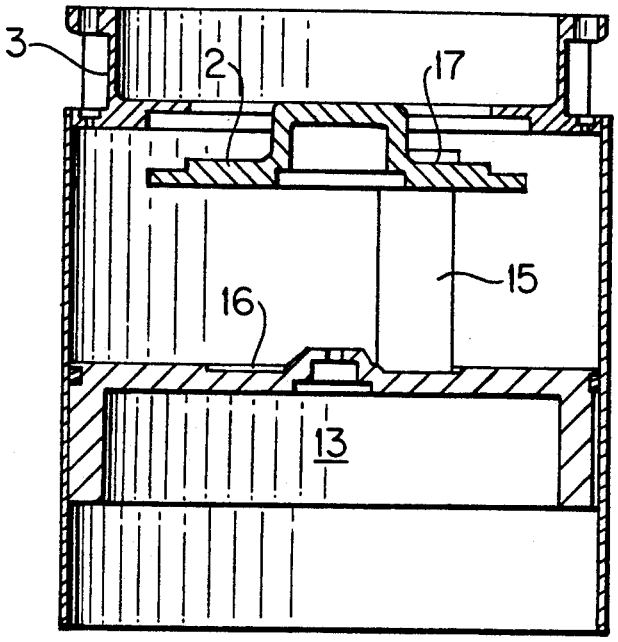
Figure 3:
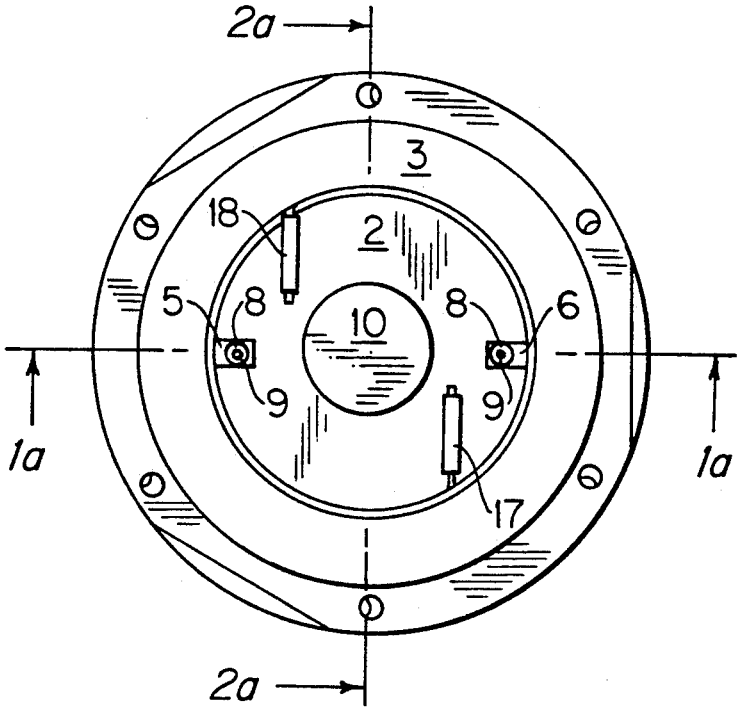

In addition to a sub-combat unit marked 12 on the figures, the protective canister 1 also contains driving sabot 13 disposed between the bottom of the canister and the sub-combat unit. The driving sabot 13 is displaceable within the interior of the canister. The displacement of the driving sabot 13 in relation to the inner lid portion 2 is determined by two brake bands 14 and 15, which are secured in both the inner bottom portion 2 and in the driving sabot. In the initial phase, the brake bands are folded in specifically adapted grooves, one of which is marked with reference numeral 16 and is visible in FIGS. 2*a* and 2*b*. The brake bands are, in the present example, produced from stainless steel of extreme extensibility.

The anchorage in the lid portion and driving sabot, respectively, is effected with the aid of through grooves 16 and locking pins 17 and 18. The locking pins for the anchorage are located in the bottom portion 2. The anchorage are located in the driving sabot is effected in accordance with the same principles, but this is not immediately apparent from the accompanying drawings.

At the predetermined time for separation, the gas-generating pyrokit 11, which appropriately consists of a powder charge, is initiated. On the deflagration of the powder charge, a pressure is built up in the combustion chamber 10 and the driving sabot 13 is given a separation speed which is determined by the size and combustion speed of the separation charge. Once the separation phase has started, the pressure increases in the pressurized volume. The force on the interior end surfaces-the insides of the bottom portions 2 and 3 and the inside of the driving sabot 13 facing towards them-imparts to the driving sabot and the combustion chamber 10 an increased separation velocity.

When the velocity of the separated parts increases and thereby the volume increase between. The volume increase takes place, however, more rapidly than the separation charge 11 produces hot powder gases and consequently the pressure falls. When the pressure has fallen to approximately atmospheric, the brake bands 14 and 15 are fully taut. However, the residual kinetic energy of the driving sabot is sufficient to sever the keepers 5 and 6. The driving sabot 13 with the bottom portion 2 connected via the brake bands 14 and 15 will also be separated from the other parts 3 and 4 of the protective canister, whereafter these separated parts follow their own trajectories towards the ground. For instance, the outer lid portion 3 may possibly have rotation brakes and friction brakes still in place, which can impart a stable trajectory to this portion, while the driving sabot with its connected lid portion will assume a tumbling trajectory. The sub-combat unit, which will have already departed from the protective canister before the driving sabot has been wholly arrested and the keepers 5 and 6 severed, will then have already achieved its own stable and completely different predetermined trajectory and had time to flip out its sensor and aerodynamic surfaces.

The present invention should not be considered as restricted to that described above and shown on the drawings, many modifications being conceivable without departing from the spirit and scope of the appended claims.

What we claim and desire to secure by Letters Patent is:

1. A method of separating a sub-combat unit from a protective canister, having a first open end and a second initially closed end, said method comprising the steps of:

a) discharging the sub-combat unit from the protective canister through said open end by causing a displacement of a driving sabot within the protective canister, the driving sabot being displaced by an elevated gas pressure generated by combustion of a gas-generating pyrotechnical charge, the displacement of the sabot imparting a trajectory to the sub-combat unit;

b) preventing the displaceable driving sabot, by arrest means interconnected between the driving sabot and the canister, from accompanying the sub-combat unit in its trajectory; and c) causing a division of the protective canister into a plurality of parts, said division ensuring a change in at least one of the trajectory and the velocity of the parts of the canister.

2. The method according to claim 1, wherein said arrest means causes a retardation of the travel of the sabot and causes a change of the direction of travel of said protective canister.

3. The method according to claim 1, wherein said arrest means causes a change in the direction of travel of said protective canister relative to the direction of travel of said sub-combat unit.

4. The method according to claim 1, wherein said division of said protective canister is caused by a force applied by said sabot to said arresting means and thereby to said protective canister.

5. The method according to claim 1, wherein the division of said protective canister is caused by a retardation of the displaceable driving sabot by the arresting means, said arresting means including at least one brake band interconnected between the driving sabot and the canister, the canister including means adapted to fracture upon the application of a force by said sabot, the division of the canister ensures that the parts assume fall velocities different than the sub-combat unit.

6. A protective canister, comprising:

a container having a first open end and a second initially closed end;

a separable sub-combat unit, said sub-combat unit being surrounded on al sides but one by said canister;

a displaceable driving sabot disposed between said sub-combat unit and the second initially enclosed end of said canister, said sabot abutting against the sub-combat unit;

a gas-generating pyrotechnical charge disposed between the sabot and the second end of the canister; and arresting means for retarding the displacement of the sabot at a predetermined displacement distance between the sabot and the second end of the canister, said arresting means being interconnected between said sabot and said canister; and means for causing a division of the protective canister into a plurality of parts and for ensuring a change in at least one of the trajectory and the velocity of the parts of the canister.

7. The protective canister according to claim 6, wherein said gas-generating charge is contained within a combustion chamber formed between said sabot and said second end of said canister.

8. The protective canister according to claim 6, wherein said arresting means comprises at least two initially folded brake bands connecting the displaceable driving sabot to the second end of the protective canister, said brake bands, in a taut state, arrest a continued displacement of said driving sabot in relation to the second end of the protective canister.

9. The protective canister according to claim 8, wherein said means for causing a division of the canister includes means for facilitating a fracture of the protective canister, said fracture facilitating means being provided on a part of the canister where said at least two brake bands are secured, said means for facilitating fracture being adapted to fracture as a result of a jerk created when the brake bands are substantially completely taut and the movement of the driving sabot is substantially arrested, whereby at least the protective canister is caused to be divided into parts, said parts entering into their own trajectories.

10. The protective canister according to claim 8, wherein the second end of said canister consists of two mutually concentrically disposed parts, said brake bands being secured in a central portion of said second end, and the concentric parts being held together by sheer pins adapted to brake when the brake bands are substantially completely taut.

* * * * *